US006915545B2

(12) United States Patent
Chen

(10) Patent No.: US 6,915,545 B2
(45) Date of Patent: Jul. 12, 2005

(54) PLAYYARD LATCH MECHANISM

(75) Inventor: Shun-Min Chen, Taipei (TW)

(73) Assignee: Kenny Cheng (TW)

( * ) Notice: Subject to any disclaimer, the term of this patent is extended or adjusted under 35 U.S.C. 154(b) by 56 days.

(21) Appl. No.: 10/459,787

(22) Filed: Jun. 12, 2003

(65) Prior Publication Data

US 2003/0229968 A1 Dec. 18, 2003

(30) Foreign Application Priority Data

Jun. 18, 2002 (CN) ..... 02239284 U

(51) Int. Cl.[7] ..... E05D 11/10

(52) U.S. Cl. ..... 16/297; 16/326; 16/327; 16/319; 5/99.1

(58) Field of Search ..... 16/231, 232, 258, 16/357, 297, 319, 324, 326, 327; 5/99.1; 403/102; 182/230; 49/394, 463, 465, 57

(56) References Cited

U.S. PATENT DOCUMENTS 4,499,619 A * 2/1985 Kassai ..... 5/99.1
4,811,437 A 3/1989 Dillner et al.
5,530,977 A * 7/1996 Wang ..... 5/99.1
5,611,634 A * 3/1997 Wang ..... 403/102
5,730,542 A 3/1998 Cheng
5,745,954 A * 5/1998 Shogan et al. ..... 16/343
5,781,944 A * 7/1998 Huang ..... 5/99.1
6,202,229 B1 * 3/2001 Cheng ..... 5/99.1
6,223,366 B1 * 5/2001 Cheng ..... 5/99.1

FOREIGN PATENT DOCUMENTS

FR 2768316 3/1999

* cited by examiner

*Primary Examiner*—Chuck Y. Mah
*Assistant Examiner*—Michael J Kyle
(74) *Attorney, Agent, or Firm*—Gauthier & Connors LLP

(57) ABSTRACT

A latch mechanism positioned at the intermediate extents of the adjacent rail components to hold such components in an aligned orientation including a saddle having opposed parallel faces and a central aperture defined in between the opposed faces. Each opposed face has at least an aperture and a plurality of guide slots provided lengthwise of the saddle. The central aperture is adapted to receive opposed rail components therein. Fastening means extend through the aperture to pivotally couple the saddle with the opposed rail components. An urging block is mounted within the central aperture of the saddle at substantially the center portion of the saddle, in between the opposed rail components. Guide pins are slidably mounted within the guide slots, and a flexible strap is provided to connect the guide pins to the urging block. Upon the actuation of the urging block, the flexible strap will be activated to move the guide pins in respective slots to a position in which the rails components are released to move to a collapsed orientation from an erect deployed orientation.

8 Claims, 4 Drawing Sheets

PLAYYARD LATCH MECHANISM

BACKGROUND OF THE INVENTION

The use of playyards of various designs and configuratios for receiving and supporting children is well known. Further, playyards with foldable capabilities are also well known. Such foldable playyards typically have hinges for converting the playyard between an erect deployed orientation and a collapsed orientation for transportation and storage.

The essential element to allow playyards to be retained in one orientation or another are hinges. Such hinges must be made safe for the child and convenient for the user. All known hinges suffer from one defect or the other.

The prior art discloses a large number of playyards with hinge capabilities. By way of example, U.S. Pat. No. 4,811,437 to Dillner discloses a playyard with complex and numerous component elements, and thus the assembling is complicated and the manufacturing cost is high.

SUMMARY OF THE INVENTION

Therefore, it is an object of this invention to provide a playyard hinge or latch which may overcome the disadvantages inherent in the known types of playyards. The present invention achieves its intended purposes, objects and advantages over the prior art through a useful and unobvious combination of component elements, through the use of a minimum number of functioning parts, at a reasonable cost to manufacture, and through the utilization of readily available and conventional materials.

It is another object of the present invention to maximize the safety of a playyard hinge or latch which may be easily and efficiently manufactured and marketed.

It is a further object of the present invention to provide a playyard hinge or latch construction which is of a durable and reliable construction.

DETAILED DESCRIPTION OF INVENTION

Generally, a playyard has a supporting frame. The frame has an upper rectangular rail assembly. The present invention includes a playyard of the type having a frame with an upper rail assembly positionable in a horizontal orientation when in a deployed orientation and formed of two side rails and two end rails with each of the rails being formed of two rail components having interior ends and exterior ends, the interior ends being pivotally coupled with respect to each other for movement between the deployed orientation wherein the rails are horizontally disposed in a common plane and a collapsed orientation wherein the rails are vertically disposed and parallel, the frame also including a lower rail assembly positionable in a horizontal orientation beneath the upper rail assembly when in a deployed orientation, the frame also including four vertically extending corner rails coupling the upper rail assembly and the lower rail assembly, the playyard also having fabric components between the upper and lower frame assemblies and between the corner rails; a hinge positioned at the intermediate extents of the end rails and side rails to allow movement of the associated rail Generally, a playyard has a supporting frame. The frame has an upper rectangular rail assembly. Such rail assembly is positionable in a horizontal orientation. Such orientation is for when the playyard is in an operative or deployed orientation. The frame assembly is provided with two longer side rails and two shorter ends rails. The rails, in some other embodiments, are all of equal length to form a square playyard. Each of the rails, whether the side rails or the end rails, is formed to include two rail components 20 (see FIGS. 2 and 3). Each rail component 20 has an interior end 22 and an exterior end (not shown).

Figure 3:
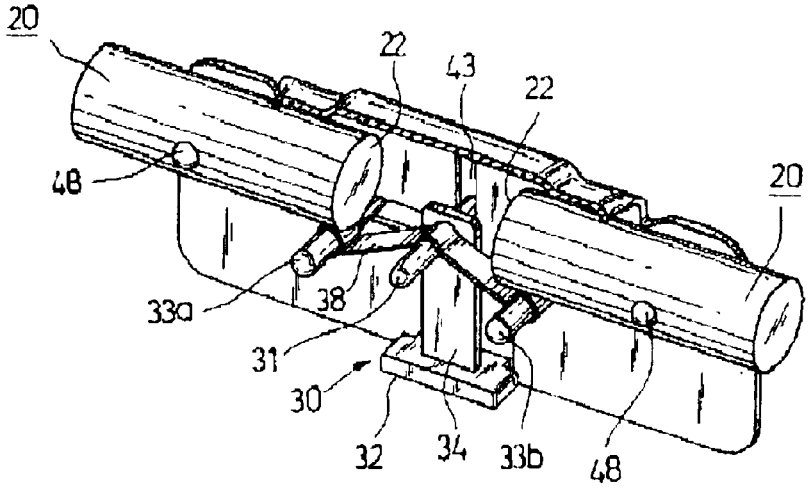
FIG. 3 is a perspective showing similar to FIG. 2 but with a portion of the saddle removed to show the interior component.
Figure 2:
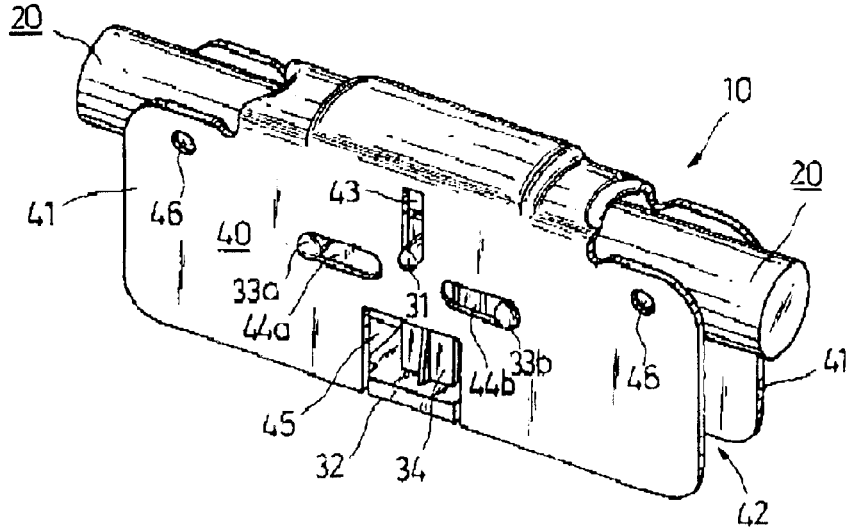
FIG. 2 is a perspective illustration of a latch mechanism constructed in accordance with the principles of the present invention.

With reference to FIGS. 2 and 3, the interior ends 22 of the rails 20 are pivotally coupled with respect to each other through a latch mechanism 10. Such latch mechanism 10 allows movement between the deployed orientation wherein the rails are horizontally disposed in a common plane with the rail components 20 being in axial alignment one with respect to another and a collapsed orientation wherein the rails 20 are all essentially disposed vertically and parallel with respect to each other.

The primary feature of the present invention lies in the latch mechanism 10. Preferably, there are four latch mechanisms of the same construction. Each latch mechanism 10 includes a saddle 40 preferably made of a rigid material and in a generally inverted U-shaped configuration. The saddle 40 includes opposed parallel faces 41, 41 and a central aperture 42 defined therebetween. Each of the faces 41, 41 are provided with rail apertures 46 and a number of elongated guide slots thereon. In a preferred embodiment, three guide slots are provided. A generally vertically extending guide slot (hereinafter called as the first guide slot) 43 is provided at an upper, central position of the saddle 40. Two generally horizontally extending and opposed guide slots (hereinafter called as the second and third guide slots) 44*a*, 44*b* are provided lengthwise of the saddle 40 substantially at an intermediate position of the saddle 40. The three guide slots 43, 44*a*, 44*b* are arranged on the saddle 40 in a generally inverted T-shaped configuration.

The central aperture 42 is suitable to receive rail components 20 therein. The rail apertures 46 are provided with rail pins 48. The rail pins 48 extend through associated apertures in the adjacent ends of the rail components 20 for pivotally coupling the saddle 40 and the adjacent interior ends of the associated rail components 20.

FIG. 3 is a perspective view substantially similar to FIG. 2, except that one of the faces 41 of the saddle is removed to reveal the interior construction of the latch mechanism 10. An urging block 30 in a generally inverted T-shaped configuration is disposed in between two rail components 20, and positioned substantially at the center of the saddle 40. A planar protruding plate 32 located at the bottom of the urging block 30 corresponds to an opening 45 provided at the lower, center portion of the saddle 40. Therefore, the protruding plate 32 is well received in the opening 45, and is accessible from the outside. A vertically extending plate 34 extends longitudinally from the protruding plate 32 upwards, to thereby forming the urging block 30 in a generally inverted T-shaped configuration. A horizontally extending guide pin 31 is mounted on the plate 34 at an upper position thereof. The guide pin 31 is adapted to slide along the first guide slot 43 to move vertically upwards and downwards.

Guide pins 33*a* and 33*b* substantially similar to the guide pin 31 in shape are slidably mounted within the second and third guide slots 44*a*, 44*b* respectively. A flexible strap 38, for example a spring piece, winds on one of the guide pins 33*a* or 33*b*, extends from the lower edge thereof to lay over the upper edge of the guide pin 31, and then extends towards the other of the guide pins 33*a* or 33*b* to wind on the same.

Figure 1:
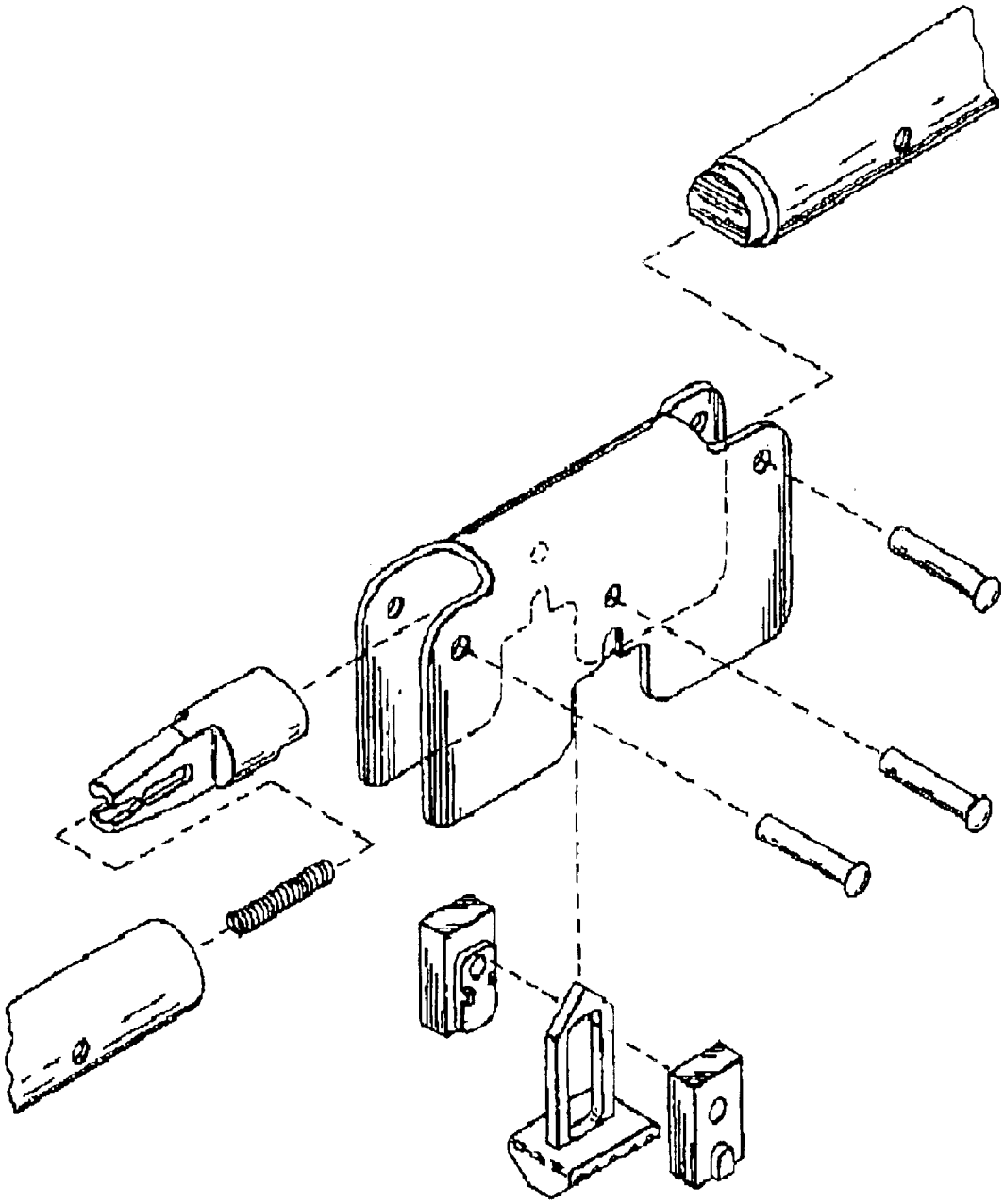
Fig.1 (Prior Art)
FIG. 1 is an exploded perspective of the playyard latch mechanism of a prior art.
Figure 4:
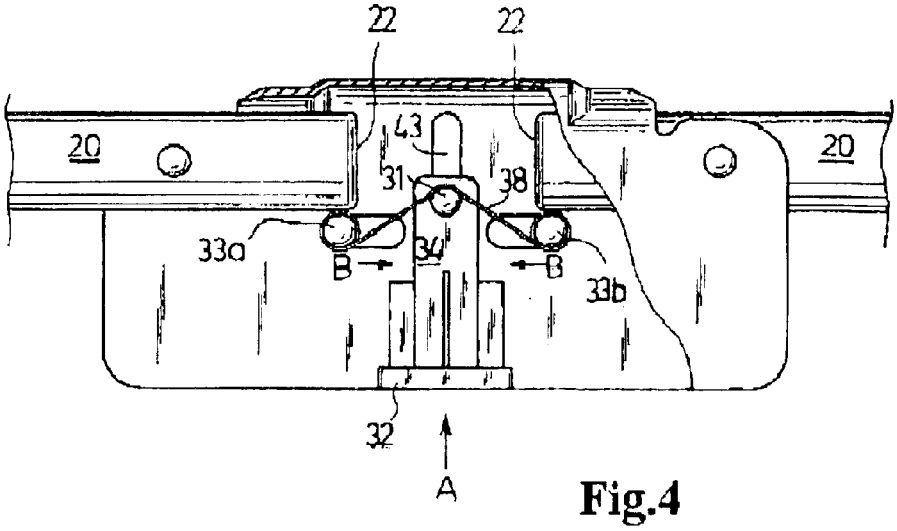
FIG. 4 is a cross-sectional view of the latch mechanism shown in FIG. 3 and illustrates the cooperative actions among the components of the latch.

FIG. 4 illustrates a partial sectional-view of the latch mechanism 10. The operation of the latch mechanism 10 will be apparent from this figure.

As the user wishes to convert the playyard from an erect deployed orientation to a collapsed orientation, he only needs to apply a force onto the protruding plate 32 of the urging block 30 to move the urging block 30 upwards in the direction A. At this instant, the guide pin 31 on the plate 34 slides along and moves vertically in the first guide slot 43, and thus the spring piece 38 is pulled upwards. Due to the resiliency of the spring piece 38, the two guide pins 33*a* and 33*b* are pulled to move towards each other by sliding horizontally in the second guide slot 44*a* and third guide slot 44*b* respectively (for the moving directions, please refer to arrows designated by B). In this manner, the two guide pins 33*a* and 33*b* move closer to each other, reach positions in proximity to the center portion of the saddle, and will no longer urge on the interior ends 22 of the rail components 20. Subsequently, the rail components 20 can be pivoted downwards, allowing the collapsing of the rail components 20 to the collapsed orientation of the playyard for storage or transportation.

Figure 5:
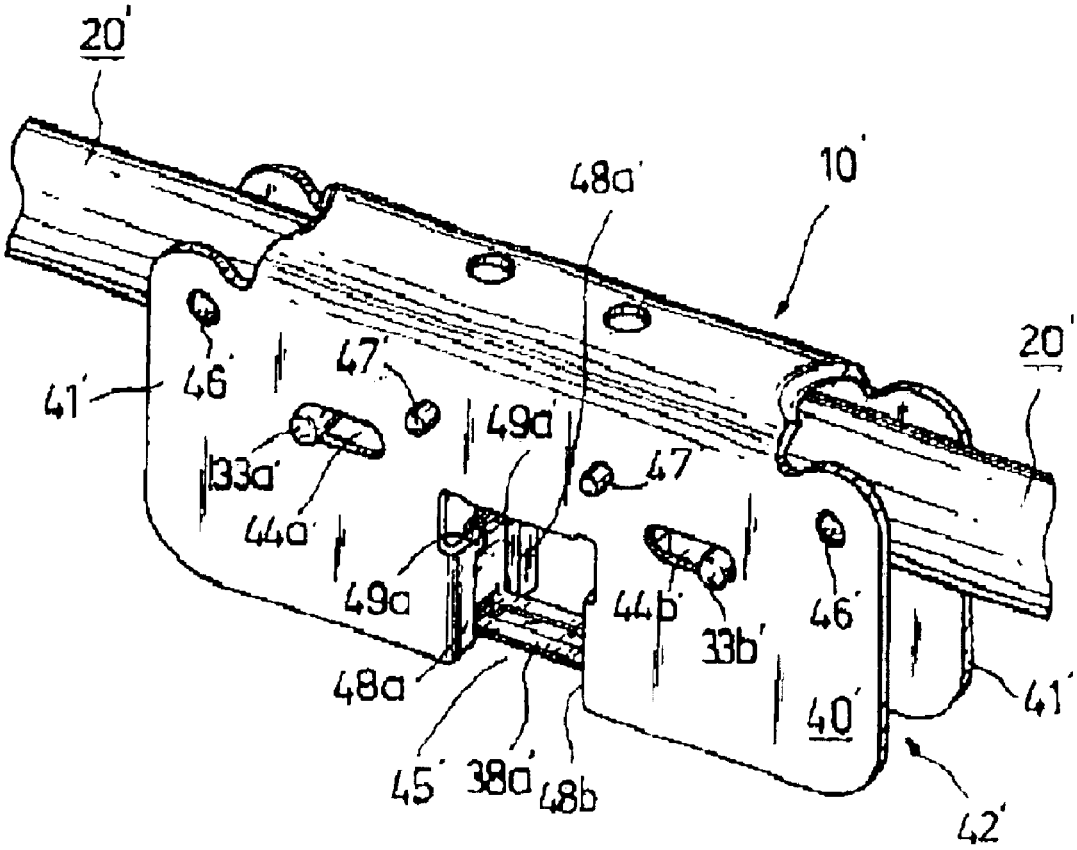
FIG. 5 is a perspective view of a latch mechanism constructed in accordance with an alternate embodiment of the invention.
Figure 6:
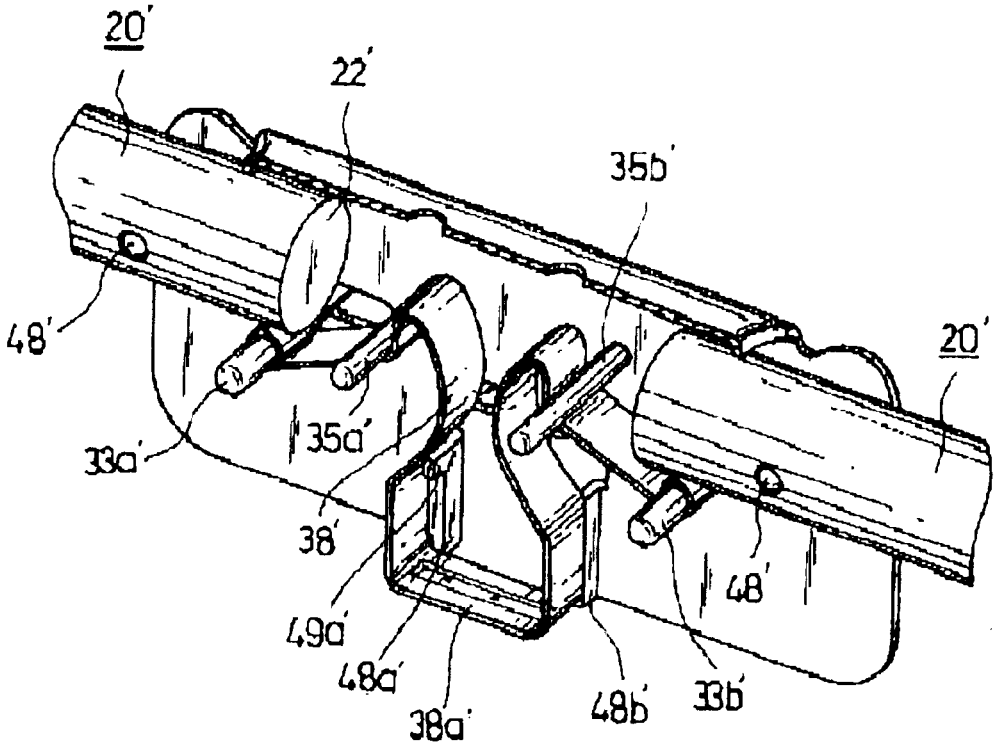
FIG. 6 is a perspective showing similar to FIG. 5 but with a portion of the saddle removed to show the interior component.

Referring to FIGS. 5 and 6, there is shown a further embodiment of the latch mechanism of the present invention. The latch mechanism 10' also includes a saddle 40' preferably made of a rigid material and in a generally inverted U-shaped configuration. The saddle 40' includes opposed parallel faces 41', 41' and a central aperture 42' defined therebetween. Each of the faces 41', 41' is provided with a pair of laterally spaced rail apertures 46' and plate apertures 47', and a pair of laterally spaced elongated guide slots 44*a*', 44*b*' thereon. The guide slots 44*a*', 44*b*' are provided lengthwise of the saddle 40' and arranged to oppose each other. Guide pins 33*a*' and 33*b*' are slidably mounted within the guide slots 44*a*', 44*b*' respectively.

The central aperture 42' is suitable to receive rail components 20' therein. The rail apertures 46' are provided with rail pins 48'. The rail pins 48' extend through associated apertures in the adjacent ends of the rail components 20' for pivotally coupling the saddle 40' and the adjacent interior ends of the associated rail components 20'.

An opening 45' generally in the shape of a square is provided on each of the opposed parallel faces 41', 41' at a lower, center portion. A pair of opposed, upstanding walls 48*a*, 48*b* are provided at each side of the opening 45'. Each of the walls 48*a*, 48*b* has an inwardly extending projection tab 49*a* (49*a*') located on the upper edge.

Figure 7:
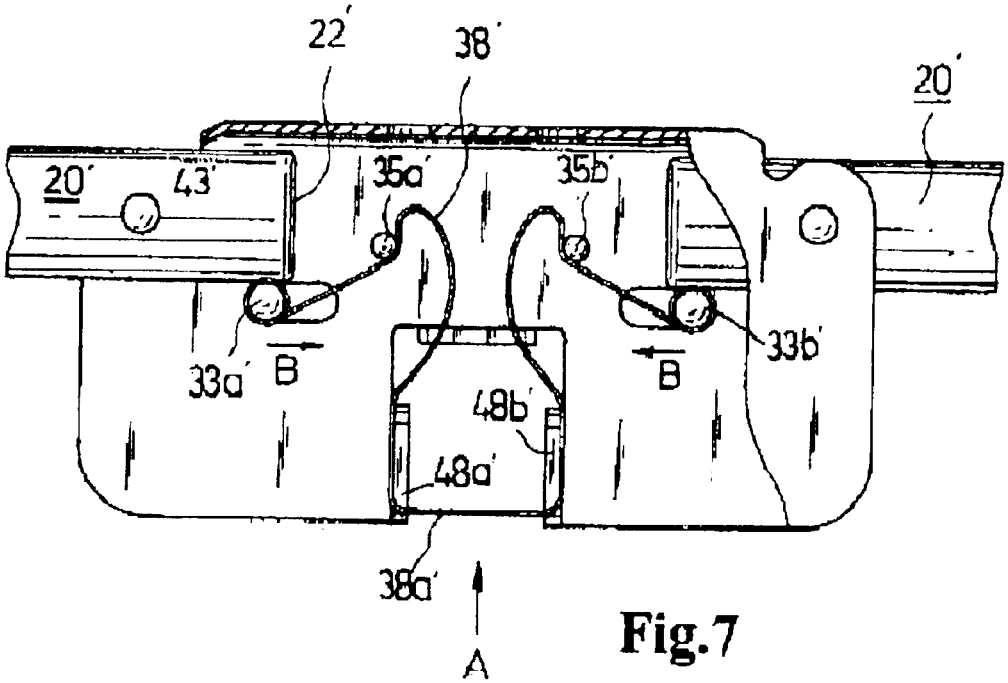
FIG. 7 is a cross-sectional view of the latch mechanism shown in FIG. 6 and illustrates the cooperative actions among the components of the latch.

FIG. 6 is a perspective view substantially similar to FIG. 5, except that one of the faces 41' of the saddle is removed to reveal the interior construction of the latch mechanism 10'. A flexible strap 38', for example a spring piece, in a generally U-shaped configuration is disposed in between two rail components 20', and positioned substantially at the center of the saddle 40'. The flexible strap 38' is arranged in a manner as shown in FIGS. 6 and 7. For example, the strap 38' first winds on guide pin 33*a*', and extends from the lower edge thereof to come to contact with the lower edge of the plate pin 35*a*' which acts as a fulcrum. After extending upwards for a slight distance, the strap 38' bends downwards to urge against the walls 48*a*, 48*a*' and is secured by means of the projection tabs 49*a*, 49*a*'. The strap 38' then extends horizontally and bends upwards to urge against the other walls 48*b* and 48*b*', and extends in the same manner as described before to pass under the plate pin 35*b*' to reach guide pin 33*b*'. By such arrangement, the strap 38' is configured in a generally U-shape. It is to be noted that the plate pins 35*a*' and 35*b*' are fixed by extending through the plate apertures 47', 47' of the pair of opposed faces 41'.

FIG. 7 illustrates a partial sectional-view of the latch mechanism 10'. The operation of the latch mechanism 10' will be apparent from this figure.

As the user wishes to convert the playyard from an erect deployed orientation to a collapsed orientation, he only needs to apply a force to the lower edge portion 38*a*' of the strap 38' in the direction A. Due to the resiliency of the strap 38' and the fulcrum actions of plate pins 35*a*' and 35*b*', the two guide pins 33*a*' and 33*b*' are pulled to move towards each other in direction B by sliding horizontally in the guide slots 44*a*' and 44*b*' respectively. In this manner, the two guide pins 33*a*' and 33*b*' move closer to each other, reach positions in proximity to the center portion of the saddle, and will no longer urge on the interior ends 22' of the rail components 20'. Subsequently, the rail components 20' can be pivoted downwards, allowing the collapsing of the rail components 20' to the collapsed orientation of the playyard for storage or transportation.

The present invention may be embodied in other specific forms without departing from the spirit or essential attributes thereof and, accordingly, reference should be made to the appended claims, rather than to the foregoing specification, as indicating the scope of the invention.

I claim:

1. A latch mechanism for a collapsible playyard, comprising:

a saddle having opposed parallel faces and a central aperture defined in between the opposed faces receiving opposed rail components, the opposed faces each having at least an aperture, a first guide slot provided at an upper, central position of the saddle, and a second and a third guide slots provided lengthwise of the saddle substantially at an intermediate position of the saddle, at least a fastening means extending through the aperture such that the saddle is pivotally coupled with the opposed rail components, an urging block mounted within the central aperture of the saddle at substantially the center portion of the saddle, and being located between the opposed rail components, a first guide pin operatively connected to the urging block and slidably received in the first guide slot, and a second and third guide pins slidably received in the second and third guide slots, respectively, a flexible strap connecting the guide pins to the urging block, whereby upon the exertion of a pressing force on the urging blocks, the flexible strap moves each of the guide pins in the respective guide slots to a position in which the rails components are released to move to a collapsed orientation from an erect deployed orientation.

2. The latch mechanism according to claim 1 wherein the urging block includes a protruding plate provided at the bottom thereof, and an upstanding plate, the protruding plate is so located as to correspond to an opening provided at the lower, center portion of the saddle, and the opening is adapted to receive the protruding plate therein, the first guide pin is a horizontally extending pin mounted on the upstanding plate at an upper position thereof, and movable in the first guide slot vertically upwards and downwards, and the second and third guide pins slidably received in the second and third guide slots, respectively, are movable in the guide slots horizontally, and opposed to each other.

3. The latch mechanism according to claim 1 or 2 wherein the fastening means is a pin.

4. The latch mechanism according to claim 1 or 2 wherein the flexible strap is formed of a spring.

5. A latch mechanism for a collapsible playyard, comprising:

a saddle having opposed parallel faces and a central aperture defined in between the opposed faces, the opposed faces receiving opposed rail components, each having at least an aperture and a pair of opposed, guide slots provided lengthwise of the saddle substantially at an intermediate position of the saddle, at least a fastening means extending through the aperture such that the saddle is pivotally coupled with the opposed rail components, a pair of guide pins, each being slidably received in each of the guide slots, a flexible strap mounted within the central aperture of the saddle at substantially the center portion of the saddle, and being located between the opposed rail components, and operatively connected to the guide pins, a pair of plate pins fixedly mounted on the opposed faces of the saddle, and each functions as a fulcrum for the flexible strap, an opening being provided on each of the opposed parallel faces at a lower, center portion, to provide an access to the flexible strap, whereby upon the exertion of a pressing force on the flexible strap, the flexible strap, talking the plate pins as fulcrums, will move each of the guide pins in the respective guide slots to a position in which the rails components are released to move to a collapsed orientation from an erect deployed orientation.

6. The latch mechanism according to claim 5, wherein each side of the opening is provided with a pair of opposed, upstanding walls with an inwardly extending projection located on the upper edge of each wall, and the strap is in a generally U-shaped configuration, and is secured by the inward extending projections located on the upper edges of the walls.

7. The latch mechanism according to claim 5 wherein the fastening means is a pin.

8. The latch mechanism according to claim 5 wherein flexible strap is formed of a spring.

* * * * *